United States Patent [19]

Shibata

[11] Patent Number: 4,790,445

[45] Date of Patent: Dec. 13, 1988

[54] CAP FOR CONTAINERS USED TO STORE VOLATILE LIQUIDS

[75] Inventor: Yoshihiko Shibata, Okayama, Japan

[73] Assignee: Japan Gore-Tex, Inc., Japan

[21] Appl. No.: 174,216

[22] Filed: Mar. 28, 1988

[30] Foreign Application Priority Data

Apr. 7, 1987 [JP] Japan ..... 62-051591[U]

[51] Int. Cl.[4] ..... B65D 51/6

[52] U.S. Cl. ..... 220/202; 220/371; 220/374

[58] Field of Search ..... 220/371, 372, 374, 202, 220/203, 205, 208, 228; 215/234, 261

[56] References Cited

U.S. PATENT DOCUMENTS

| | | | |
|---|---|---|---|
| 1,490,186 | 4/1924 | Rowe | 220/205 |
| 2,606,687 | 8/1952 | Marek | 220/228 |
| 3,385,468 | 5/1968 | Fleming et al. | 220/371 |

*Primary Examiner*—Donald F. Norton
*Attorney, Agent, or Firm*—Mortenson & Uebler

[57] ABSTRACT

A cap for containers used to store volatile liquids is provided characterized by a gas venting port formed in the main body of the cap which is attached to an opening in a container, a filter accomodation space which connects with the aforementioned gas venting port formed in the bottom surface of the main body of the cap, a channel formed in the central portion of a filter assembly installed in the aforementioned filter accomodation space, two hydrophobic porous filter membranes, one installed between the filter assembly and the aforementioned gas venting port and one installed over the innermost end of the aforementioned channel, whereby a liquid passageway is formed, and an aqueous liquid partly, but not completely, fills the interior of the assembly.

4 Claims, 2 Drawing Sheets

CAP FOR CONTAINERS USED TO STORE VOLATILE LIQUIDS

BACKGROUND OF THE INVENTION

The present invention relates to a cap for containers which are used to store volatile liquids. The object of the present invention is to provide a cap for containers used to store volatile liquids which can appropriately discharge volatilized gas under ordinary conditions and which can prevent the leakage of liquid when the container is turned upside down or on its side.

The present invention provides a cap for containers, such as gasoline tanks, used to store volatile liquids which is designed so that (a) vaporized gasoline can be effectively discharged so that accidents such as explosions are prevented, and (b) there is no leakage of gasoline when the container is turned over.

The installation of caps on openings in tanks used to store liquids has been a general practice in the past. The caps employed in such cases have been made of metal or a synthetic resin, and are appropriately equipped with packing for sealing purposes.

Furthermore, such caps have been equipped with gas venting ports which incorporate a spring or ball valve; in such cases, gas can be vented under ordinary conditions, and when the tank is turned over, the gas venting port is blocked by the abovementioned spring or ball so that leakage of the volatile liquid is prevented.

In the case of the abovementioned conventional caps, the gasoline inside the tank vaporizes so that the gas pressure is increased when the temperature around the tank rises. This leads to a danger of explosion, and is extremely dangerous even if an explosion does not occur, i.e., the gas may jet out when the cap is removed. Accordingly, the areas where such tanks may be stored are necessarily restricted and, for example, the use of such general caps is not allowed in the case of tanks installed in automobiles.

Caps equipped with a gas venting port which has a blocking means such as a spring or ball make it possible to eliminate the disadvantages of the abovementioned conventional caps. However, such caps are expensive and have a complicated structure. Furthermore, in the case of long-term use, the action of such caps may be hindered by rusting or fouling of the spring so that the desired action cannot always be obtained. Furthermore, such caps also suffer from the disadvantages of increased size.

SUMMARY OF THE INVENTION

A vented cap for a container used to store volatile liquids is provided comprising a main body having a vent port and means for affixing the cap to the container, a filter accommodation space within the main body adjacent the vent port, a filter assembly affixed in the filter accomodation space, the filter assembly having an open inner channel and an outer annular space, the inner channel extending from the bottom of the filter assembly part way into, but not completely through, said filter assembly, the inner channel having a first hydrophobic membrane installed over the innermost end of the channel, and a second hydrophobic membrane installed between the vent port and the filter assembly, thus forming a liquid passageway between the first and second membrane, and an aqueous liquid partly, but not completely, filling the annular space such that, in an upright position, the liquid does not immerse the first membrane. The inner channel preferably has a bend therein. The preferable liquid is water. The cap may have a port leading into the annular space for replenishing the liquid.

BRIEF DESCRIPTION OF THE INVENTION

DETAILED DESCRIPTION OF THE INVENTION AND PREFERRED EMBODIMENTS WITH REFERENCE TO THE DRAWINGS

A cap for containers used to store volatile liquids is provided characterized by a gas venting port formed in the main body of the cap which is attached to an opening in a container, a filter accomodation space which connects with the aforementioned gas venting port formed in the bottom surface of the main body of the cap, a channel formed in the central portion of a filter assembly installed in the aforementioned filter accomodation space, two hydrophobic porous filter membranes, one installed between the filter assembly and the aforementioned gas venting port and one installed over the innermost end of the aforementioned channel, whereby a liquid passageway is formed, and an aqueous liquid partly, but not completely, fills the interior of the assembly.

Specifically, the present invention provides a cap for containers used to store volatile liquids, which is characterized by the fact that (a) a gas venting port is formed in the main body of a cap which is attached to an opening in a container, (b) a filter accomodation space which connects with the aforementioned gas venting port is formed in the bottom portion of the main body of the aforementioned cap, (c) a channel is formed in the central portion of a filter assembly which is installed in the aforementioned filter accomodation space, (d) respective hydrophobic porous filter membranes are installed between the aforementioned filter assembly and the aforementioned gas venting port, and between the innermost end of the aforementioned channel and the gas venting port so that a liquid passage area is formed, and (e) an aqueous solution is accomodated inside the aforementioned filter assembly.

When the container such as a tank is in a normal state, the filter solution flows to the bottom portion of the interior of the filter assembly. Accordingly, the vaporized gas generated inside the container reaches the aforementioned gas venting port via the channel in the central portion of the filter assembly and extends into the liquid passage area between the channel and the gas venting port between the respectively installed filter membranes. This gas is then vented into the atmosphere via the gas venting port.

When the container is turned over, the liquid accomodated inside the filter assembly enters the aforementioned channel and fills it. This liquid enters the liquid passage area between the aforementioned porous filter membranes so that the outflow of the liquid from the container is effectively prevented.

An example of the present invention is described below with reference to the accompanying drawings.

Figure 1:
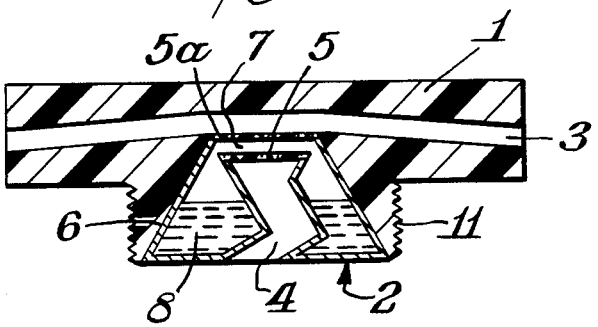
FIG. 1 is a side elevational view, in cross-section, of the cap according to the invention.
Figure 2:
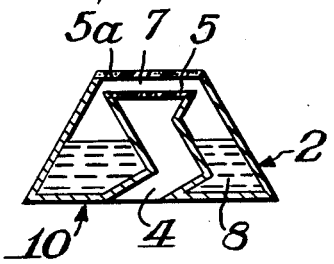
FIG. 2 is a side elevational view, in cross-section, of the filter assembly of the invention.

Referring to FIGS. 1 and 2, a gas venting port 3 is formed in the main body of a cap 1 which is installed over an opening in a container such as a gasoline tank. A filter accomodation space 6 which connects with the aforementioned gas venting port 3 is formed in the bottom surface of the aforementioned main body of the cap 1, and a filter assembly 2 is installed in this accomodation space. This filter assembly 2 is designed as follows: i.e., a hydrophobic porous filter membrane 5 is installed at the apex of a frustoconical filter assembly 10 which has a channel 4 which is preferably bent at an intermediate point formed through its center. Further, a similar hydrophobic porous filter membrane 5a is installed at the innermost end of the aforementioned channel 4. A liquid passage area 7 is formed between the two filter membranes 5, 5*a*, and an aqueous solution 8 is accomodated inside the filter assembly 10.

Threads 11 are formed around the circumference of the portion of the main body of the cap 1 which is inserted into the opening of the tank, so that the cap can be screwed into the opening. Since the channel 4 is bent at an intermediate point, the liquid inside the tank (solvent, gasoline, etc.) will not splash directly agains the filter membrane 5 even if the tank is jarred or vibrated.

The aforementioned main body of the cap 1 is made of metal or of a resin which is insoluble in the liquid being stored. This material should be shock-resistant so that there is no damage to the cap in the case of accidental dropping during handling. It is desirable that the aforementioned filter membrane 5, 5*a* be made of a porous material which is hydrophobic and insoluble in the liquid being stored, and that that material have an osmotic pressure of 0.001 kg/cm$^2$ or greater, and a gas permeability of 5 cm$^3$/cm$^2$/min or greater at 0.001 kg/cm$^2$. A surface tension of 50 dyn/cm or greater is appropriate.

It is desirable that the aforementioned filter assembly 10 be made of a resin which is water resistant and which is insoluble in the liquid being stored, i.e., polyacetal or polytetrafluoroethylene. Furthermore, it is desirable that the filter solution 8 have a surface tension of 60 dyn/cm or greater, and this filter solution should be insoluble in the liquid stored inside the tank.

Figure 3:
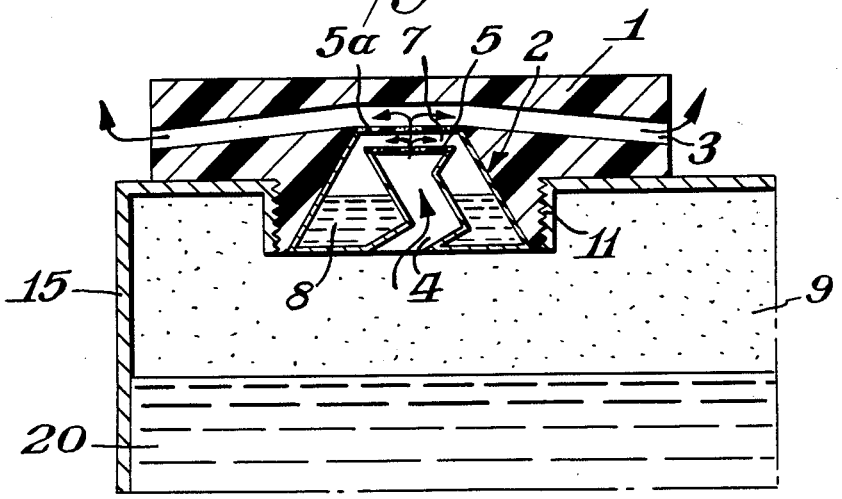
FIG. 3 is a side elevation, in cross-section, of the cap of the invention installed in a container of a volatile liquid.
Figure 4:
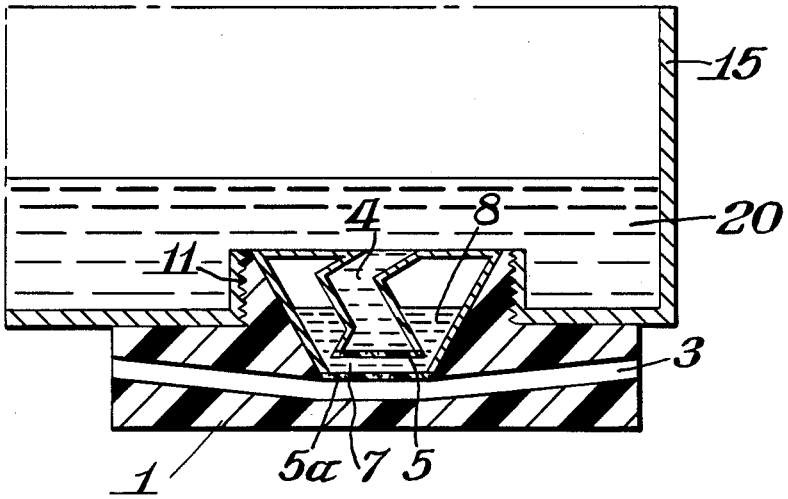
FIG. 4 is an elevational view, in cross-section, of the cap of the invention installed in an inverted container of a volatile liquid.

In the case of the present invention, vaporized gas 9 generated from the stored liquid 20 such as gasoline in the empty space at the top of the container 15 such as a tank passes through the channel 4 and porous filter membranes 5, 5*a* and is vented into the atmosphere via the gas venting port 3 when the container 15 is in a normal state as shown in FIG. 3. On the other hand, when the container 15 is turned over, the stored liquid 20 inside the container 15 floods the cap area and attempts to pass through the channel 4 and filter membranes 5, 5*a* (as shown in FIG. 4); however, the aqueous filter solution 8 inside the fiter case assembly 10, which will not pass through the filter membranes 5, 5*a*, enters the space between the filter membranes 5, 5*a* so that the passage of the stored liquid 20 is prevented. In such a case, furthermore, even if a portion of the stored liquid 20 should somehow pass through the filter membrane 5, this passing liquid 20 is lighter than the filter solution 8 so that it floats on the surface of the filter solution 8 and does not escape via the gas venting port 3.

Figure 5:
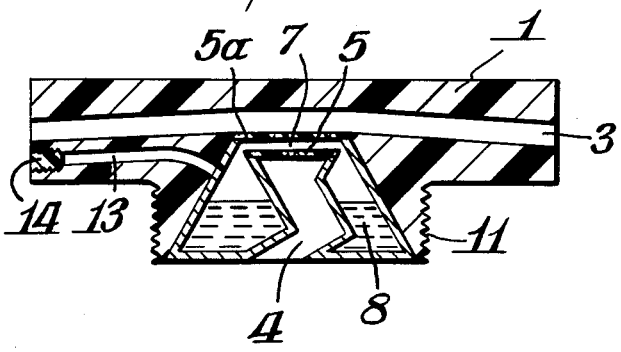
FIG. 5 is an alternate embodiment of the cap of the invention having a port for replenishing the supply of the aqueous liquid contained therein.

It is desirable that the filter solution 8 have a specific gravity of 1.0 or greater and a boiling point of 100° C. or greater. A liquid with a boiling point of 130° C. or greater is even more desirable. An example of such a liquid is methyl mercuric iodide. Furthermore, in cases where this filter solution 8 has been depleted so that replenishment is necessary, a structure such as that shown in FIG. 5 can be used. Specifically, a replenishment port 13 is formed in the main body of the cap 1 separately from the gas venting port 3, and this replenishment port is plugged with a plug 14. The replenishment port 13 connects with the interior of the filter assembly 10. The filter solution 8 such as water inside the filter assembly 10 can easily be replenished via such a replenishment port 13 by means of a syringe or injection pump. Of course, the cap may be assembled without any filter solution 8 during manufacture and storage. The filter storage 8 may be injected after the cap has been installed on a container such as a tank.

As an example of manufacture, a filter assembly 10 and a cap main body 1 were used which were both molded from a polyacetal resin. Porous, expanded polytetrafluoroethylene films with a void ratio of 90% were used for the aforementioned filter membranes 5, 5*a*. These films were obtained by expanding a polytetrafluoroethylene film as disclosed in U.S. Pat. No. 3,953,566 so that the countless microfibers were formed into a spiderweb-like structure between micronodes (thickness: about 10 microns) with a mean pore diameter of about 5 microns created between these microfibers. As a result, under conditions where the solvent gas in the container 15 had a vapor pressure of 0.001 kg/cm$^2$, gas was vented into the atmosphere at a rate of 10 cm$^3$/cm$^2$/min at the filter membranes 5, 5*a*.

Furthermore, the areas of the aforementioned filter membranes 5, 5*a* were both 3 cm$^2$, and the volume of the space between these filter membranes 5, 5*a* was 1.5 cm$^3$. 20 cc of filter solution 8, water in this case, was introduced into the filter case assembly 10. This example of manufacture was used as a cap for an 18-liter gasoline tank. When the tank was turned upside down, absolutely no leakage of the gasoline stored inside was observed.

As described above, the cap of the present invention is designed so that under normal conditions the vaporized gas accumulating inside the storage container can be effectively discharged, so that, when the aforementioned container is turned over, leakage of the liquid stored inside the container can be reliably prevented. Furthermore, since this invention merely involves the installation of a filter case assembly with attached filter membranes inside a hollow cap body, the cap of the present invention can be manufactured relatively easily and inexpensively. Furthermore, the cap of the present invention functions very reliably. Accordingly, the present invention has great practical merit.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A vented cap for a container used to store volatile liquids comprising:

a main body having a vent port and means for affixing said cap to said container, a filter accomodation space within said main body adjacent said vent port, a filter assembly affixed in said filter accomodation space, said filter assembly having an open inner channel and an outer annular space, said inner channel extending from the bottom of said filter assembly part way into, but not completely through, said filter assembly, the inner channel having a first hydrophobic porous membrane installed over the innermost end of said channel, and a second hydrophobic porous membrane installed between said vent port and said filter assembly, thus forming a liquid passageway between said first and second membrane, and an aqueous liquid partly, but not completely, filling said annular space such that, in an upright position, said liquid does not immerse said first membrane.

2. The cap of claim 1 wherein said inner channel has a bend therein.

3. The cap of claim 1 wherein said liquid is water.

4. The cap of claim 1 having a port leading into said annular space for replenishing said liquid.

* * * * *